US009357286B2

(12) United States Patent
Seo

(10) Patent No.: US 9,357,286 B2
(45) Date of Patent: May 31, 2016

(54) COAXIAL SOUND GENERATING UNIT CARTRIDGE AND A TWO-WAY EARPHONE USING THE SAME

(76) Inventor: Ki Young Seo, Gyeonggi-Do (KR)

( * ) Notice: Subject to any disclaimer, the term of this patent is extended or adjusted under 35 U.S.C. 154(b) by 0 days.

(21) Appl. No.: 13/634,621

(22) PCT Filed: Mar. 11, 2011

(86) PCT No.: PCT/KR2011/001698
§ 371 (c)(1),
(2), (4) Date: Sep. 13, 2012

(87) PCT Pub. No.: WO2011/115390
PCT Pub. Date: Sep. 22, 2011

(65) Prior Publication Data

US 2013/0010998 A1 Jan. 10, 2013

(30) Foreign Application Priority Data

Mar. 15, 2010 (KR) ..... 10-2010-0022780

(51) Int. Cl.
*H04R 25/00* (2006.01)
*H04R 1/26* (2006.01)
*H04R 1/10* (2006.01)

(52) U.S. Cl.
CPC ..... *H04R 1/1058* (2013.01); *H04R 1/26* (2013.01); *H04R 1/1016* (2013.01)

(58) Field of Classification Search
USPC ..... 381/23.1, 60, 150–152, 160–167, 381/170–182, 184–186, 189–191, 312–331, 381/337–369, 370–433; 181/144, 145, 147, 181/128, 129, 198, 199
See application file for complete search history.

(56) References Cited

U.S. PATENT DOCUMENTS

| | | | | |
|---|---|---|---|---|
| 4,965,836 | A * | 10/1990 | Andre et al. | 381/370 |
| 8,660,289 | B2 * | 2/2014 | Tiscareno | 381/380 |
| 2009/0220113 | A1 * | 9/2009 | Tiscareno | 381/309 |

FOREIGN PATENT DOCUMENTS

| | | | |
|---|---|---|---|
| KR | 20-1994-0000417 | Y1 | 1/1994 |
| KR | 10-2008-0088770 | A | 10/2008 |
| KR | 20-2010-0002262 | U | 3/2010 |

* cited by examiner

*Primary Examiner* — Davetta W Goins
*Assistant Examiner* — Amir Etesam
(74) *Attorney, Agent, or Firm* — Revolution IP, PLLC

(57) ABSTRACT

A two-way earphone includes: a main earphone body including a first sound generating unit and a second sound generating unit; a housing having a first holder part where the first sound generating unit is inserted, and a second holder part where the second sound generating unit is inserted, and a partition wall having at least one first sound releasing hole for releasing the sound generated from the first sound generating unit between the first holder part and the second holder part; a cap assembled onto the second holder part, and including at least one second sound releasing hole for releasing, to the outside, a mixed sound resulting from the intermixing of the sound released through the first sound releasing hole and the sound generated from the second sound generating unit.

13 Claims, 4 Drawing Sheets

COAXIAL SOUND GENERATING UNIT CARTRIDGE AND A TWO-WAY EARPHONE USING THE SAME

TECHNICAL FIELD

The present invention relates to a coaxial sound generating unit cartridge and a two-way earphone having the same, and more particularly, to a coaxial sound generating unit cartridge and a two-way earphone having the same, which coaxially dispose a woofer used as a low-sound generating means generating a low sound, and a tweeter used as a high-sound generating means generating a high sound in a definite internal space of the cartridge and thus, may remove a sound interference between the low sound and the high sound to improve a sound quality and may improve a manufacturing process by miniaturizing the woofer and the tweeter.

BACKGROUND ART

Generally, a headphone covers the whole of a user's ear to transmit a sound to the user, and an earphone is inserted into an ear canal of a user to transmit a sound to the user.

Also, the earphone has a built-in speaker, which vibrates air by using a high-low motion generated when an electrical input signal is transferred to a sound coil of a sound panel, and therefore, converts an electric signal to a sound to transmit the sound to a user.

However, in an earphone or an headphone having a built-in speaker, it is impossible to reproduce every tone of audio-frequency bands with a constant sound pressure level SPL, and even though a satisfactory SPL is outputted from a specific band, a quality of the sound may be changed according to a size of the speaker, a material of a vibration plate or the like.

Therefore, various speaker systems such as a so-called two-way speaker, a three-way speaker, a multi-way speaker or the like are made in response to various requirements of users and used by assembling speakers such as a woofer, a midrange, a tweeter or the like, the speakers used as a sound generating means. Here, a playback audio bandwidth of each of the speakers is different.

However, in a related art two-way earphone or headphone, a woofer generating a low sound is disposed in parallel with a tweeter generating a high sound in an abscissa axis, and thus, the scheme of using the woofer and the tweeter is unsuitable for an earphone which has to be miniaturized and lightened. Therefore, an earphone adopting a balance armature type speaker that is an ultra-small speaker is widely used, the balance armature type speaker being used in a hearing aid. However, a process of manufacturing the earphone having the balance armature type speaker is complicated and there are limitations in terms of a reproduction of a low sound.

Moreover, in an earphone inserted into a user's ear to be used, because an internal space, in which a speaker as a sound generating means is built, is small, it is impossible to simultaneously build two or more speakers in the earphone, the speakers having different playback audio bandwidths. Therefore, it is difficult to meet various requirements of users who want to listen to the three-dimensional sound such as a sense of a front-and-rear direction or space sense, and there are limitations in making a high-quality earphone.

SUMMARY OF INVENTION

Accordingly, the present invention is directed to provide a coaxial sound generating unit cartridge and a two-way earphone using the same that substantially obviate one or more problems due to limitations and disadvantages of the related art. An aspect of the present invention is directed to provide a coaxial sound generating unit cartridge and a two-way earphone having the same, which include sound generating means that have different playback audio bandwidths and are coaxially disposed in a definite internal space, and thus, enable an assembling process to be simplified, provide a user with a high-quality sound having a three-dimensional effect, and enable a exclusivity to be achieved when miniaturization is being maintained.

To achieve these and other advantage and in accordance with the purpose of the invention, as embodied and broadly described herein, there is provided a coaxial sound generating unit cartridge in an internal space of which a first sound generating unit and a second sound generating unit are disposed, the first sound generating unit and the second sound generating unit for generating sounds of mutually different playback audio bandwidths upon input of an electrical signal, the coaxial sound generating unit cartridge comprising: a housing comprising a first holder part into which the first sound generating unit is inserted to be disposed, a second holder part into which the second sound generating unit is inserted to be disposed, and a partition wall formed between the first holder part and the second holder part, at least one of first sound releasing holes being formed in the partition wall and a sound generated from the first sound generating unit being drained through the first sound releasing hole; and a cap coupled to the second holder part, at least one of second sound releasing holes being formed in the cap to penetrate the cap and a mixed sound having a sound generated from the second sound generating unit mixed with the sound drained through the first sound releasing holes being drained through the second sound releasing hole.

The first sound generating unit may be configured with a low sound generating unit generating a middle low sound, or a high sound generating unit generating a high sound having playback audio bandwidths relatively higher than playback audio bandwidths of the middle low sound.

A line-disposed groove may be formed in an internal surface of the first holder part or in an external surface of the first holder part, at least one of signal lines are formed in the line-disposed groove, and the signal line is electrically connected to the second sound generating unit.

The second holder part may comprise a plurality of division ribs which are vertically extended from the top surface of the partition wall to a certain height, are formed to protrude along a circumference of the partition wall and are separated by a certain interval in order for the first sound releasing hole to be exposed to the outside.

A height of the second holder part may be higher than or equal to the second sound generating unit, and thus, when the second holder part and the cap are assembled, a mixing space, in which sounds having different playback audio bandwidth are mixed, is formed between the cap and the second sound generating unit.

The second holder part may comprise a spacer which contacts a bottom surface of the second sound generating unit, and thus, a certain interval is formed between the second sound generating unit and the partition wall.

The spacer may be extended from the partition wall or the spacer may be configured with an independent member separated from the partition wall.

Moreover, to achieve these and other advantage and in accordance with the purpose of the invention, as embodied and broadly described herein, there is provided a two-way earphone inserted into a user's ear, the two-way earphone comprising: a main earphone body on the inside of which are respectively disposed the first sound generating unit and the second sound generating unit for generating sounds of mutually different playback audio bandwidths upon input of an electrical signal is inputted are disposed; a housing comprising a first holder part into which the first sound generating unit is inserted to be disposed, a second holder part into which the second sound generating unit is inserted to be disposed, and a partition wall formed between the first holder part and the second holder part, at least one of first sound releasing holes being formed in the partition wall and a sound generated from the first sound generating unit being drained through the first sound releasing hole; a cap coupled to the second holder part, at least one of second sound releasing holes being formed in the cap to penetrate the cap and a mixed sound having a sound generated from the second sound generating unit mixed with the sound drained through the first sound releasing holes being drained through the second sound releasing hole; and a base plate providing a power source and electric signal with the first sound generating unit and the second sound generating unit.

The first sound generating unit may be configured with a low sound generating unit generating a middle low sound, or a high sound generating unit generating a high sound having playback audio bandwidths relatively higher than playback audio bandwidths of the middle low sound.

The main earphone body may comprise a front body and a rear body connected to a cable to be coupled to the rear portion of the front body, an insert member inserted into a user's ear being formed in the front portion of the front body, and a connecting terminal being formed in one end of the cable and electrically connected to the base plate in order to provide a power source and an electric signal with the first sound generating unit and the second sound generating unit.

A line-disposed groove may be formed in an internal surface of the first holder part or in an external surface of the first holder part, at least one of signal lines are formed in the line-disposed groove, and the signal line is extended from the base plate to be electrically connected to the second sound generating unit.

The second holder part may comprise a plurality of division ribs which are vertically extended from the top surface of the partition wall to a certain height, are formed to protrude along a circumference of the partition wall and are separated by a certain interval in order for the first sound releasing hole to be exposed to the outside.

A height of the second holder part is higher than or equal to the second sound generating unit, and thus, when the second holder part and the cap are assembled, a mixing space, in which sounds having different playback audio bandwidth is mixed, is formed between the cap and the second sound generating unit.

The second holder part may comprise a spacer which contacts a bottom surface of the second sound generating unit, and thus, a certain interval is formed between the second sound generating unit and the partition wall.

The spacer may be extended from the partition wall or the spacer may be configured with an independent member separated from the partition wall.

Advantageous Effects

According to the embodiments, the present invention enables an assembling process to be simplified by coaxially disposing a first sound generating unit generating a middle low sound and a second sound generating unit generating a high sound in a housing which is assembled in an internal space of a main earphone body, thereby saving the manufacturing cost and the present invention mixes the middle low sound and the high sound without a sound interference to transmit a mixing sound with a three-dimensional effect to a user of the earphone, and thus, enable a exclusivity to be achieved when miniaturization is being maintained.

DESCRIPTIONS OF REFERENCE NUMBERS

Figure 1:
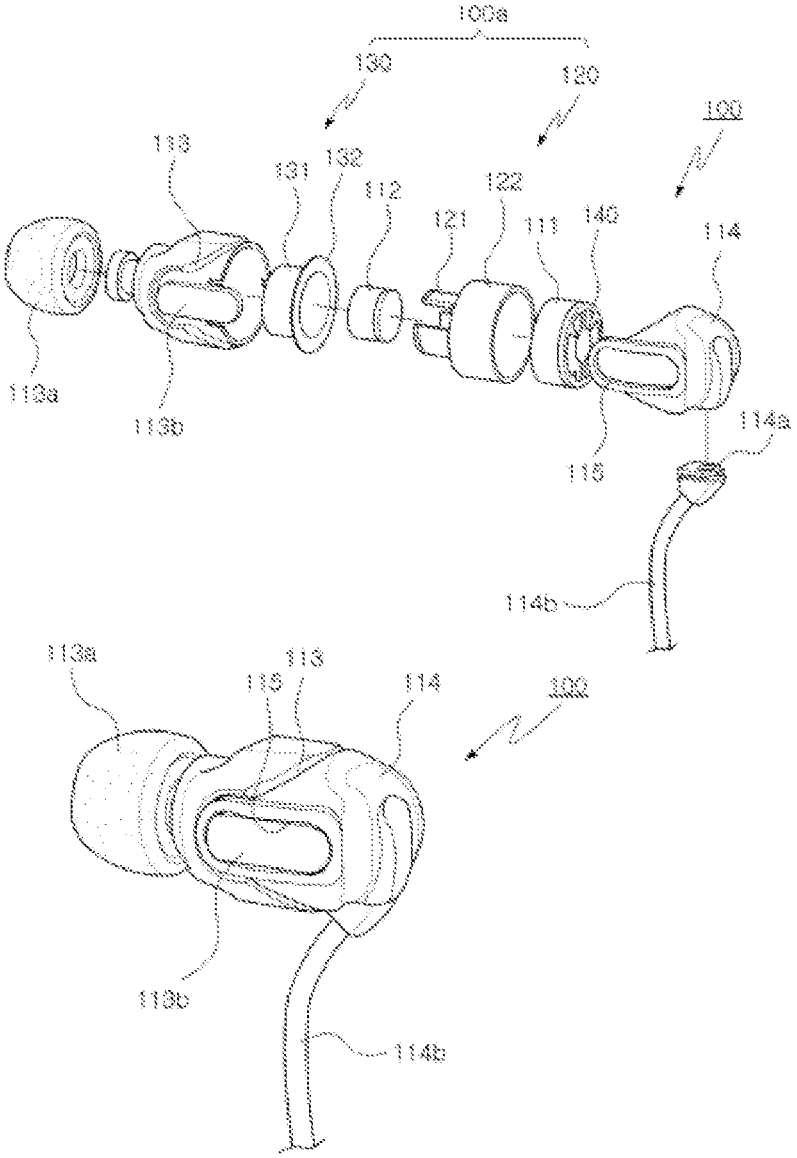
FIG. 1 is an exploded perspective view illustrating a two-way earphone having a coaxial sound generating unit cartridge according to an embodiment of a present invention.

110: main earphone body
111: first sound generating unit
112: second sound generating unit
113: front body
114: rear body
120: housing
121: first holder part
122: second holder part
123: partition wall
124: spacer
125: first sound releasing hole
126: line disposed groove
130: cap
131: cylindrical pipe
132: Flange
135: second sound releasing hole
140: base plate

MODES FOR CARRYING OUT THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

A two-way earphone 100 according to an embodiment of the present invention, as shown in FIGS. 1 to 5, includes a main earphone body 110, coaxial sound generating unit cartridge 100*a* and a base plate 140. Here, the coaxial sound generating unit cartridge 100*a* includes a hosing 120 and a cap 130.

As shown in FIG. 1, a first sound generating unit 111 which generates a middle low sound when an electrical signal is inputted and the second sound generating unit 112 which generates a high sound when an electrical signal is inputted are disposed in a certain-size internal space of the main earphone body 110, and the main earphone body 110 is inserted into a user's ear.

In the above-described description, the first sound generating unit 111 has been described as including a woofer generating a middle low sound, and the second sound generating unit 112 has been described as including a tweeter generating a high sound of which a playback audio bandwidth is relatively higher than that of the middle low sound. However, the present embodiment is not limited thereto, and therefore, the first sound generating unit 111 may selectively include a tweeter generating a high sound, and the second sound generating unit 112 may selectively include a woofer generating a middle low sound.

The main earphone body 110 includes a front body 113 and a rear body 114 connected to a cable 114*b*. Here, an insert member 113*a* inserted into a user's ear is formed in the front portion of the front body 113, and a connecting terminal 114*a* is formed in one end of the cable 114*b* and is electrically connected to a base plate 140 in order to provide a power source and an electric signal with the first sound generating unit 111 and the second sound generating unit 112. The rear body 114 is coupled to the rear portion of the front body 113 to form an internal space having a certain size.

Here, a display part 113*b*, in which letters, figures or the like are displayed, is formed in an external surface of the front body 113, and a coupling part 115 is formed in the rear body 114. When the coupling part 115 is coupled to the front body 113, the coupling part 115 penetrates the one side of the frond body 113 in order to generate a coupling strength to expose the display part 113*b* to the outside.

In the above-described description, the display part 113*b* has been described and shown as being formed in the front body 113 and the coupling part 115 has been described and shown as being formed in the rear body 114. However, the present embodiment is not limited thereto, and therefore, the coupling part 115 may be formed in the front body 113 and the display part 113*b* may be formed in the rear body 114.

The insert member 113*a* may be formed of a silicon material such that a user does not feel inconvenience and comfortably uses the same when the insert member 113*a* is inserted into a user's ear to contact a skin of the ear. Also, each of the front body 113 and the rear body 114 may be formed of a resin used in an injection-molding.

A releasing hole penetrating a front portion of the front body 113 is formed in the front portion coupled to the insert member 113*a*, and thus, enables a middle low sound and high sound generated from inside the housing 120 to be transferred to inside the ear.

Figure 2:
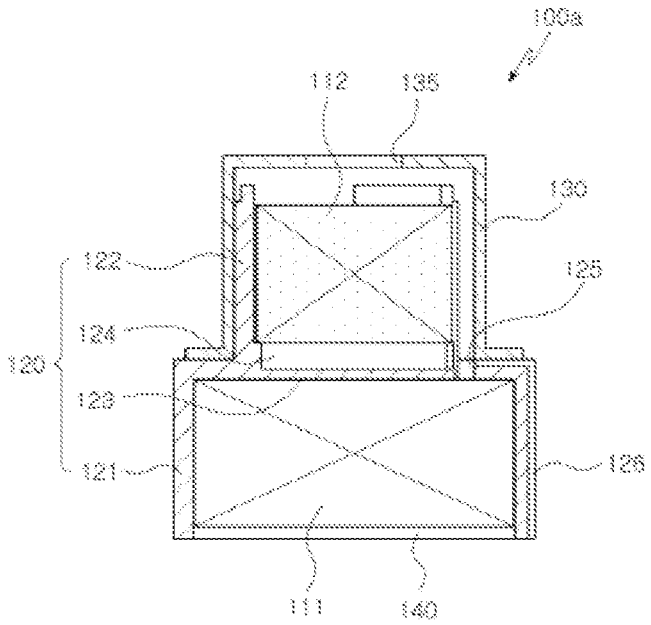
FIG. 2 is a longitudinal sectional view illustrating a coaxial sound generating unit cartridge according to an embodiment of a present invention.
Figure 3:
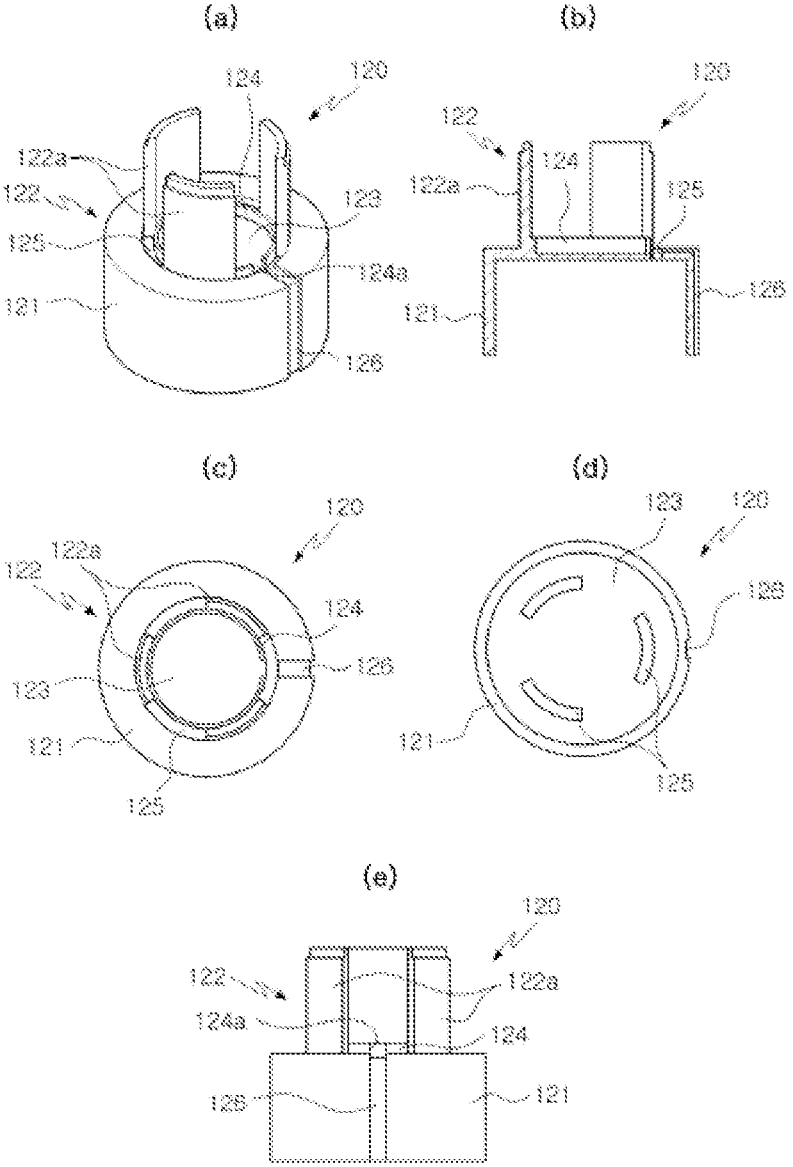
FIG. 3 is an exemplary diagram illustrating a housing included in the coaxial sound generating unit cartridge according to an embodiment of the present invention in which a portion (a) is a perspective view, a portion (b) is a longitudinal sectional view, a portion (c) is a plan view, a portion (d) is a bottom view and a portion (e) is a side view.
Figure 4:
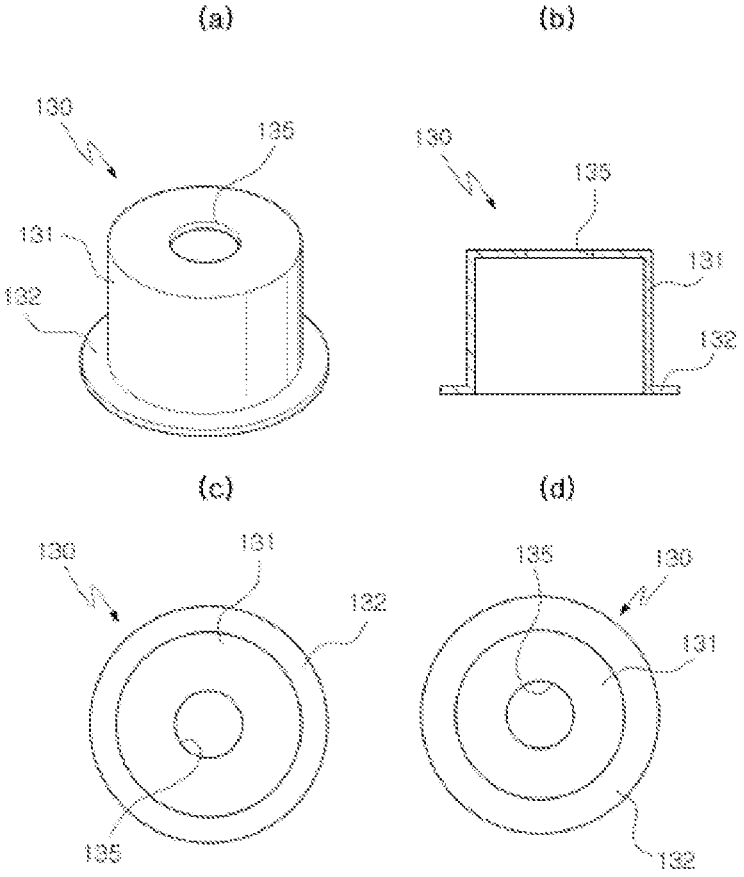
FIG. 4 is an exemplary diagram illustrating a cap included in the coaxial sound generating unit cartridge according to an embodiment of the present invention in which a portion (a) is a perspective view, a portion (b) is a longitudinal sectional view, a portion (c) is a plan view and a portion (d) is a bottom view.
Figure 5:
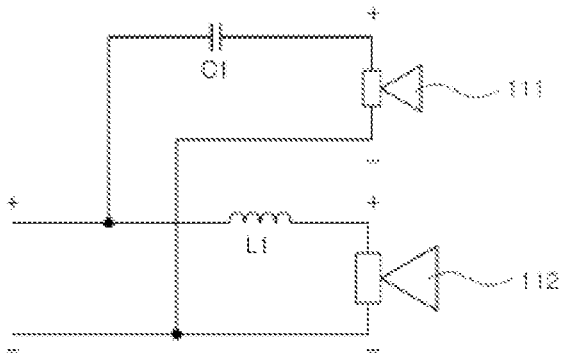
FIG. 5 is a circuit diagram included in the two-way earphone according to an embodiment of the present invention.

As shown in FIGS. 2 to 4, the coaxial sound generating unit cartridge 100*a* includes a housing 120 and a cap 130. Here, the first sound generating unit 111 and the second sound generating unit 112 are inserted into the housing 120 to be coaxially disposed therein. Also, the cap 130 covers a front portion of the housing 120 except a sound releasing hole, the front portion of the housing 120 being open to an upper side of the housing 120.

In the above-described description, the coaxial sound generating unit cartridge 110*a* has been described and shown as being mounted in an internal space of the main earphone body 110 inserted into the user's ear. However, the present embodiment is not limited thereto, and therefore, the coaxial sound generating unit cartridge 110*a* may be applied to a headphone covering both ears of a user, or a small or large-medium size speaker.

The housing 120, as shown in FIGS. 2 and 3, includes a first holder part 121, a second holder part 122 and a partition wall 123. The first holder part 121 used as a support structure and is formed in a cylindrical shape, and a lower portion of the first holder part 121 is opened. Therefore, the first sound generating unit 111 such as a woofer, which generates playback audio bandwidths including a middle low sound, is inserted into the lower portion of the first holder part 121 to be disposed therein.

The second holder part 122 used as a support structure and is formed in a cylindrical shape, and an upper portion of the second holder part 121 is opened. Therefore, the second sound generating unit 112 such as a tweeter, which generates playback audio bandwidths including a high sound, is inserted into the upper portion of the second holder part 122 to be disposed therein.

The partition wall 123 is formed between the first holder part 121 and the second holder part 122, and at least one of first sound releasing holes 125 penetrating the partition wall 123 is formed in the partition wall 123. Therefore, a middle low sound generated in the first sound generating unit 111 may be drained through the first sound releasing hole 125.

Here, the first holder part 121 and the second holder part 122 are respectively formed in two concentric circles in order for the first sound generating unit 111 and the second sound generating unit 112 to be coaxially arranged and to be vertically stacked. Also, an internal diameter of an internal surface of the first holder part 121 may be greater than that of an internal surface of the second holder part 122. Here, the internal surface of the first holder part 121 contacts an external surface of the first sound generating unit 111 and the internal surface of the second holder part 122 contacts an external surface of the second sound generating unit 112.

Furthermore, in the above-described description, the first sound generating unit 111 has been described and shown as being inserted into the first holder part 121 to be disposed therein and the second sound generating unit 112 has been described and shown as being inserted into the second holder part 122 to be disposed therein. However, the present embodiment is not limited thereto, and therefore, the second sound generating unit 112 may be inserted into the first holder part 121 to be disposed therein and the first sound generating unit 111 may be inserted into the second holder part 122 to be disposed therein.

Accordingly, the first sound generating unit 111 inserted into the first holder part 121 to be disposed therein and the second sound generating unit 112 inserted into the second holder part 122 to be disposed therein are coaxially disposed in a virtual axis, and an external diameter of the first sound generating unit 111 is relatively greater than that of the second sound generating unit 112.

Moreover, a line-disposed groove 126, in which at least one of the signal lines are disposed, is formed in an external surface of the first holder part 121. The signal line is extended from the base plate 140 to be electrically connected to a base plate disposed in the second sound generating unit 112 and transmits a power source and an electric signal. Also, the line-disposed groove 126 may be extended from a lower portion of the first holder part 121 to the first sound releasing hole 125.

Here, the line-disposed groove 126 has been described and shown as being formed in an external surface of the first holder part 121. However, the present embodiment is not limited thereto, and therefore, the line-dispose groove 126 may be formed in the internal surface of the first holder part 121 in a type where the line-dispose groove is recessed.

Also, the second holder part 122 includes a plurality of division ribs 122*a* which is vertically extended from the top surface of the partition wall 123 to a certain height. The division ribs 122*a* are formed to protrude along a circumference of the partition wall 123 and separated by a certain interval in order for a first sound releasing hole 125, through which a sound such as a middle low sound generated from the first sound generating unit 111 is drained, to be exposed to the outside.

Therefore, an open part whose shape is a slit is formed between the division ribs 122*a*. The open part is used as a drain path draining a sound which is generated from the first sound generating unit 111 and outputted through the first sound releasing hole 125.

Furthermore, a height of the second holder part 122 may be higher than or equal to the second sound generating unit 112. Therefore, when the second holder part 122 and the cap 130 are assembled, a mixing space where a middle low sound and a high sound are mixed is formed between the cap 130 and the second sound generating unit 112.

Here, the plurality of the division ribs 122*a* has been described and shown as being configured with three ribs separated by a certain interval along a circumference. However, the present embodiment is not limited thereto, and therefore, the plurality of the division ribs 122*a* may be configured with two or more ribs.

Moreover, in order for a certain interval to be formed between the second sound generating unit 112 and the partition wall 123, the second holder part 122 includes a spacer 124 contacting a bottom surface of the second sound generating unit 112. Therefore, a connection area for connecting the second sound generating unit 112 to the signal line may be secured.

A recess may be formed in the spacer 124 and formed in a portion corresponding to the line disposed groove 126 formed in an external surface of the first holder part 121, and thus, the signal line may be extended and disposed in the recess 124*a*.

In the above-described description, the spacer 124 has been described and shown as being integrally formed in a boundary region between the second holder part 122 and the partition wall 123. However, the present embodiment is not limited thereto, and therefore, the spacer 124 may be an independent member, which is independently formed in a top surface of the partition wall 123 to be separated from the second holder part 122 and has an approximate ring shape.

When the spacer 124 is the independent member, a placement height of the second sound generating unit 112 may be varied by varying a height of the spacer 124 formed between the second sound generating unit 112 and the partition wall 123, and thus, a size of a mixing space, in which a middle low sound and a high sound having different playback audio bandwidths are mixed, may be expanded or reduced by varying the placement height. Therefore, a more excellent three-dimensional sound quality may be provided.

As shown in FIGS. 2 and 4, the top surface of the second holder part 122, into which the second sound generating unit 112 is inserted to be disposed, is open and the cap 130 covers the top surface of the second holder part 122. Also, the cap 130 used as a covering member is inserted into the second holder part 122 from an upper portion to a lower portion of the second holder part 122 in order for a low portion of the cap 130 to contact the partition wall 123.

At least one of a second sound releasing hole 135, which penetrates a top surface of the cap 130 and drain a mixing sound to the outside, is formed in the cap 130 corresponding to the second sound generating unit 112. Here, the mixing sound includes a middle low sound drained through the first sound releasing hole 125 and a high sound generated from the second sound generating unit 112.

The cap 130 includes a cylindrical pipe 131 and a flange 132. An internal surface of the cylindrical pipe 131 contacts an external surface of the second holder part 122 and at least one of the second sound releasing holes 135 are formed in a top surface corresponding to the second sound generating unit 112 to penetrate the top surface of the cylindrical pipe 131. Also, the flange 132 is extended in parallel to the partition wall 123 from a lower portion of the cylindrical pipe 131, and thus, a bottom surface of the flange 132 contacts a top surface of the partition wall 123.

Here, to prevent the middle low sound and the high sound generated from the first sound generating unit 111 and the second sound generating unit 112 from being leaked to the outside, the flange 132 may be coupled to the partition wall 123 by a medium of an adhesive.

The base plate 140, as shown in FIG. 2, is integrally formed in the bottom surface of the first sound generating unit 111 and inserted into the first holder part 121 together with the first sound generating unit 111 to be disposed in the first holder part 121. Also, the base plate 140 is connected to the cable 114*b* assembled in the rear body 114 by a medium of the connecting terminal 114*a* and is connected to the first and second sound generating unit 111 and 112 in parallel, and thus, provide a power source and electric signal driving the first and second generating unit 111 and 112 with the first and second generating unit 111 and 112.

Accordingly, when the power source and electric signal is inputted to the first sound generating unit 111 and the second sound generating unit 112 through the base plate 140, a middle low sound generated from the first sound generating unit 111 is transmitted to inside the second holder part 122 coupled to the cap 130, through the first sound releasing hole 125 which is formed in the partition wall 123 to penetrate the partition wall 123.

Subsequently, a high sound generated from the second sound generating unit 112 is mixed with the middle low sound, which is transferred to the second holder part 122, in the mixing space between the cap 130 coupled to the second holder part 122 and the second sound generating unit 112 without a sound interference to be converted to a mixing sound, and the mixing sound is drained to the outside through the second sound releasing hole 135.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A coaxial sound generating unit cartridge in an internal space of which a first sound generating unit and a second sound generating unit are disposed, the first sound generating unit and second sound generating unit for generating sounds of mutually different playback audio bandwidths upon input of an electrical signal, the coaxial sound generating unit cartridge comprising: a housing comprising a first holder part into which the first sound generating unit is inserted to be disposed, a second holder part into which the second sound generating unit is inserted to be disposed, and a partition wall formed between the first holder part and the second holder part, at least one of first sound releasing holes being formed in the partition wall and a sound generated from the first sound generating unit being drained through the first sound releasing hole; and a cap coupled to the second holder part, at least one of second sound releasing holes being formed in the cap to penetrate the cap and a mixed sound having a sound generated from the second sound generating unit mixed with the sound drained through the first sound releasing holes being drained through the second sound releasing hole; wherein a line-disposed groove is formed in an internal surface of the first holder part or in an external surface of the first holder part, at least one of signal lines are formed in the line-disposed groove, and the signal line is electrically connected to the second sound generating unit.

2. The coaxial sound generating unit cartridge of claim 1, wherein the first sound generating unit is configured with a low sound generating unit generating a middle low sound, or a high sound generating unit generating a high sound having a playback audio bandwidths relatively higher than a playback audio bandwidths of the middle low sound.

3. The coaxial sound generating unit cartridge of claim 1, wherein the second holder part comprises a plurality of division ribs which are vertically extended from the top surface of the partition wall to a certain height, are formed to protrude along a circumference of the partition wall and are separated by a certain interval in order for the first sound releasing hole to be exposed to the outside.

4. The coaxial sound generating unit cartridge of claim 1, wherein a height of the second holder part is higher than or equal to the second sound generating unit, and thus, when the second holder part and the cap are assembled, a mixing space, in which sounds having different playback audio bandwidth is mixed, is formed between the cap and the second sound generating unit.

5. The coaxial sound generating unit cartridge of claim 1, wherein the second holder part comprises a spacer which contacts a bottom surface of the second sound generating unit, and thus, a certain interval is formed between the second sound generating unit and the partition wall.

6. The coaxial sound generating unit cartridge of claim 5, wherein the spacer is extended from the partition wall or the spacer is configured with an independent member separated from the partition wall.

7. A two-way earphone inserted into a user's ear, the two-way earphone comprising: A main earphone body on the inside of which are respectively disposed the first sound generating unit and the second sound generating unit for generating sounds of mutually different playback audio bandwidths upon input of an electrical signal; a housing comprising a first holder part into which the first sound generating unit is inserted to be disposed, a second holder part into which the second sound generating unit is inserted to be disposed, and a partition wall formed between the first holder part and the second holder part, at least one of first sound releasing holes being formed in the partition wall and a sound generated from the first sound generating unit being drained through the first sound releasing hole; a cap coupled to the second holder part, at least one of second sound releasing holes being formed in the cap to penetrate the cap and a mixed sound having a sound generated from the second sound generating unit mixed with the sound drained through the first sound releasing holes being drained through the second sound releasing hole; and a base plate providing a power source and electric signal with the first sound generating unit and the second sound generating unit; wherein a line-disposed groove is formed in an internal surface of the first holder part or in an external surface of the first holder part, at least one of signal lines are formed in the line-disposed groove, and the signal line is extended from the base plate to be electrically connected to the second sound generating unit.

8. The two-way earphone of claim 7, wherein the first sound generating unit is configured with a low sound generating unit generating a middle low sound, or a high sound generating unit generating a high sound having a playback audio bandwidths relatively higher than a playback audio bandwidths of the middle low sound.

9. The two-way earphone of claim 7, wherein the main earphone body comprises a front body and a rear body connected to a cable to be coupled to the rear portion of the front body, an insert member inserted into a user's ear being formed in the front portion of the front body, and a connecting terminal being formed in one end of the cable and electrically connected to the base plate in order to provide a power source and an electric signal with the first sound generating unit and the second sound generating unit.

10. The two-way earphone of claim 7, wherein the second holder part comprises a plurality of division ribs which are vertically extended from the top surface of the partition wall to a certain height, are formed to protrude along a circumference of the partition wall and are separated by a certain interval in order for the first sound releasing hole to be exposed to the outside.

11. The two-way earphone of claim 7, wherein a height of the second holder part is higher than or equal to the second sound generating unit, and thus, when the second holder part and the cap are assembled, a mixing space, in which sounds having different playback audio bandwidth is mixed, is formed between the cap and the second sound generating unit.

12. The two-way earphone of claim 7, wherein the second holder part comprises a spacer which contacts a bottom surface of the second sound generating unit, and thus, a certain interval is formed between the second sound generating unit and the partition wall.

13. The two-way earphone of claim 12, wherein the spacer is extended from the partition wall or the spacer is configured with an independent member separated from the partition wall.

* * * * *